US008763175B2

(12) United States Patent
Li et al.

(10) Patent No.: US 8,763,175 B2
(45) Date of Patent: Jul. 1, 2014

(54) FIXING STRUCTURE OF FAUCET

(71) Applicant: Globe Union Industrial Corp., Taichung (TW)

(72) Inventors: Chunhung Li, Taichung (TW); Weimien Hsu, Taichung (TW); Wanhong Tan, Guangdong Pr (CN); Yongiun Wu, Guangdong Pr (CN); Qiuyong Li, Guangdon Pr (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 13/959,992

(22) Filed: Aug. 6, 2013

(65) Prior Publication Data

US 2014/0075667 A1 Mar. 20, 2014

(30) Foreign Application Priority Data

Sep. 17, 2012 (CN) ..... 2012 2 0475180

(51) Int. Cl.
*E03C 1/04* (2006.01)

(52) U.S. Cl.
USPC ..... 4/677; 4/676; 4/678; 137/359; 137/801

(58) Field of Classification Search
USPC ..... 4/675–678; 137/315.12, 359, 801
See application file for complete search history.

(56) References Cited

U.S. PATENT DOCUMENTS

| | | | | |
|---|---|---|---|---|
| 4,848,395 | A | 7/1989 | Krippendorf | |
| 5,388,287 | A * | 2/1995 | Tischler et al. | 4/678 |
| 5,515,882 | A * | 5/1996 | Hennis | 4/678 |
| 6,757,921 | B2 | 7/2004 | Esche | |
| 7,748,406 | B2 | 7/2010 | Pilatowicz et al. | |
| 2009/0276954 | A1 * | 11/2009 | Davidson | 137/801 |
| 2011/0186162 | A1 * | 8/2011 | Farag et al. | 137/801 |

* cited by examiner

*Primary Examiner* — Tuan N Nguyen
(74) *Attorney, Agent, or Firm* — Alan Kamrath; Kamrath IP Lawfirm, P.A.

(57) ABSTRACT

A fixing structure of a faucet is fixed on a sink countertop with a hole and contains a faucet having a housing, a pull-out spray head, a mixing valve, and a water supply set. The water supply set includes a cold-water inlet pipe, a hot-water inlet pipe, and a mixing outlet pipe. A positioning device includes a base having a peripheral fence, a bottom fence, and a mouth. The bottom fence has a limiting face and at least one orifice, the limiting face has a channel, two stop posts, and an abutting face. Two screw rods extend out of the hole and are rotated above the base. Two clamping blocks are screwed with the two screw rods and are limited by the two stop posts to rotate when the two screw rods are rotated, and the two clamping blocks move upwardly to retain a bottom end of the sink countertop.

7 Claims, 7 Drawing Sheets

FIXING STRUCTURE OF FAUCET

FIELD OF THE INVENTION

The present invention relates to a fixing structure of a faucet.

BACKGROUND OF THE INVENTION

A conventional faucet for a sink platform in a kitchen is provided with a pull-out spray head to facilitate the wash of pots and plates, and so on, in the sink rather than under the faucet. Because the function of the conventional faucet is well known, further remarks are omitted.

A two handle pull-out faucet disclosed in U.S. Pat. No. 7,748,406 contains a body for receiving a spray hose, a hot water valve, a cold water valve, a first pipe for flowing cold water, a second pipe for flowing hot water, and a third pipe for flowing the cold water and the hot water, wherein a cold water grip and a hot water grip are used to operate the cold water valve and the hot water valve, so that the cold water from the first pipe and the hot water from the second pipe flow into a water passages of the body, and they are controlled and mixed at a certain quantity and a proportion. The third pipe has a water hammer and couples with the pull-out spray head via the spray hose.

A single handle pull-out faucet disclosed in U.S. Pat. No. 6,757,921 contains a body having a mixing valve and a single grip fixed on the body to operate the mixing valve, hence cold water from a cold water pipe and hot water from a hot water pipe flow into the mixing valve and mix together at a certain quantity and a proportion.

The two handle pull-out faucet is merely applicable for a sink countertop with three holes rather than a single hole. But the single handle pull-out faucet is suitable for the sink countertop with three holes and a single hole. Likewise, the single handle pull-out faucet has a grip to control water flow easily and quickly.

It is to be noted that the single handle pull-out faucet contains a body, and the body has a seat with outer threads and inserted into the hole of the sink countertop, and the seat has a fiber gasket and a metal piece fitted thereon and has a maintaining loop screwed thereon, the maintaining loop is also screwed with a screw bolt which abuts against the metal piece, the seat and the body are fixed on the sink countertop, so a user has to install the single handle pull-out faucet in a narrow space under the sink countertop troublesomely.

Furthermore, the third pipe for flowing the cold water and the hot water has a flexible spray hose and a valve outlet pipe, and the spray hose is in connection with the pull-out spray head and is used to receive the water hammer, the valve outlet pipe couples with the mixing valve and the spray hose, such that the pull-out spray head is pulled outward and retracted inward easily.

A mixing faucet disclosed in U.S. Pat. No. 4,848,395 is used for a cleaning countertop and contains a housing retained on a bottom end of the cleaning countertop by ways of a clamping means and fixed in a hole of the cleaning countertop. To improve a connection of the cleaning countertop, a sleeve having a passage and served to receive water pipe lines is secured in the hole, such that the housing is fitted with the seat from a top surface of the cleaning countertop and then is locked at a locking position. The clamping means includes two screw holes, two clamping screws inserting through the two screw holes so as to fix the seat, and two lugs screwed with the two clamping screws, such that a tool is applied to rotate the two clamping screws above the seat so that the two lugs move upwardly to retain a bottom end of the cleaning countertop, hence the seat is clamped on the cleaning countertop.

Nevertheless, no any limiting structure is disclosed below the seat so as to prevent the two lugs from rotation while rotating the two clamping screws, so the two lugs rotate easily with the two clamping screws without retaining the cleaning countertop. In other words, the two lugs are fixed below the cleaning countertop and offset easily without retaining the bottom end of the cleaning countertop securely.

Also, no any fixing structure is disclosed in U.S. Pat. No. 4,848,395, so the seat will loosen after a period of using time.

The present invention has arisen to mitigate and/or obviate the afore-described disadvantages.

SUMMARY OF THE INVENTION

The primary object of the present invention is to provide a fixing structure of a faucet which is capable of overcoming the shortcomings of the conventional fixing structure of the faucet.

To obtain the above objectives, a fixing structure of a faucet is fixed on a sink countertop with a hole and contains: a faucet, a positioning device, two screw rods, and two clamping blocks.

The faucet includes a housing, a pull-out spray head, a mixing valve mounted in the housing, and a water supply set; the water supply set includes a cold-water inlet pipe connected with the mixing valve, a hot-water inlet pipe, and a mixing outlet pipe; one end of the mixing outlet pipe connects with the pull-out spray head.

The positioning device includes a base having a peripheral fence, a bottom fence connected with the peripheral fence, and a mouth defined on the bottom fence; the bottom fence has a limiting face extending downwardly from the mouth, and the limiting face is a successive and closed wall in a circumferential direction and passes through the hole of the sink countertop and has an outer rim retained with the hole, such that the base aligns with the hole; the limiting face also has a channel for communicating with the water supply set and has two stop posts coupled therewith and downwardly extending out of the hole, a bottom end of each stop post extends beyond a bottom end of the limiting face; the bottom fence has at least one orifice defined on an outer periphery of the limiting face and is adjacent to the two stop posts; the bottom fence also has an abutting face formed on a bottom end thereof and around the limiting face and the at least one orifice so as to abut against a top wall of the hole of the sink countertop.

The two screw rods extend out of the hole of the sink countertop from the at least one orifice of the base and are rotated above the base.

The two clamping blocks are screwed with the two screw rods and are limited by the two stop posts to rotate when the two screw rods are rotated, and then the two clamping blocks move upwardly to retain a bottom end of the sink countertop so as to further fix the base in the hole of the sink countertop.

Thereby, the limiting face of the base forms a successive and closed wall in the circumferential direction so that after the base is placed into the hole of the sink countertop, the base aligns with the hole accurately, such that the base is fixed on the sink countertop easily and precisely.

The each stop post of the base facilitates rotating the each screw rod above the base directly so as to control a movement of the each clamping block, such that the clamping block retains with the bottom end of the sink countertop tightly, and the user does not have to operate the each clamping block or to fix the base below the sink countertop, thus fixing the base easily and quickly.

The each stop post is coupled with the limiting face so as to increase its structural reinforcement even though the each stop post is made of plastic material. For example, the each clamping block is limited by the each stop post to rotate when the each screw rod is rotated, and then the each clamping block moves upwardly to retain the bottom end of the sink countertop so as to further fix the base in the hole of the sink countertop securely.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
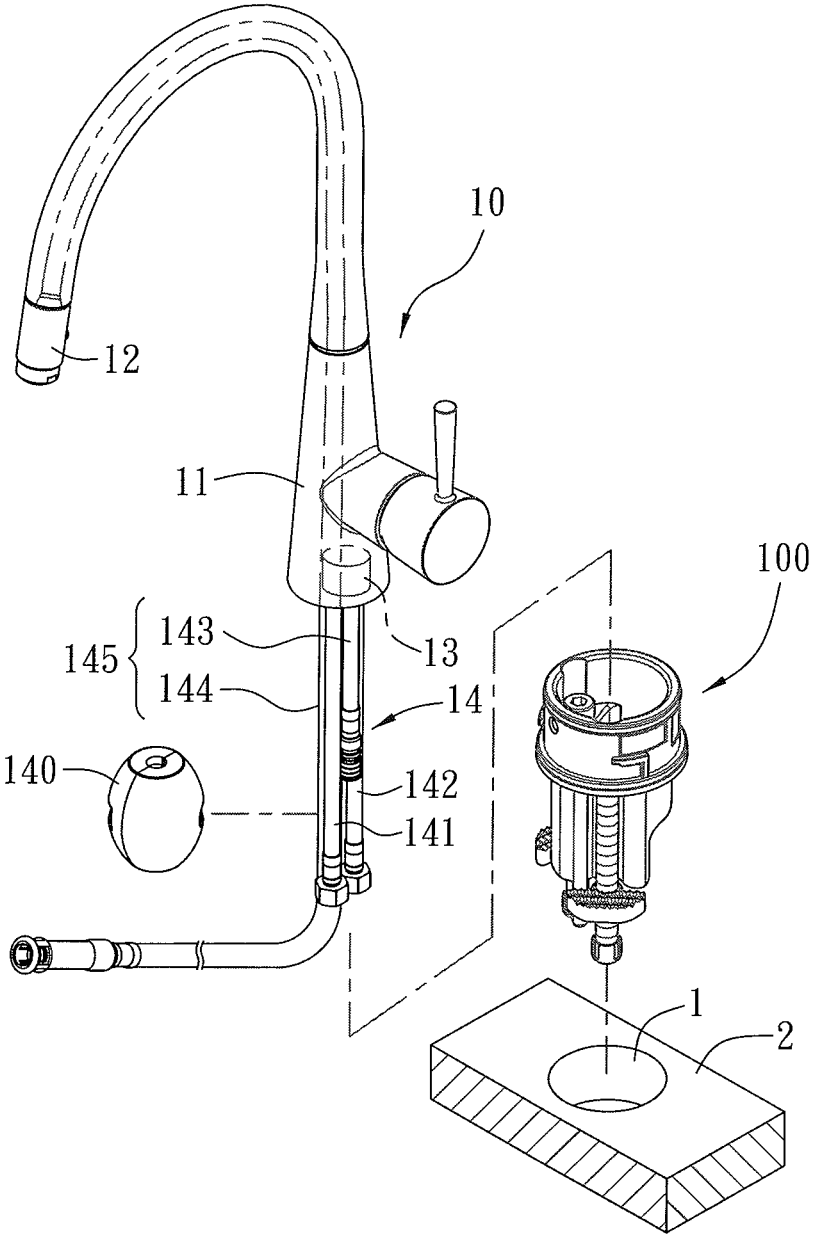
FIG. 1 is a perspective view showing most of the exploded components of a fixing structure of a faucet according to a preferred embodiment of the present invention; wherein the faucet is fixed on a sink countertop around a water sink.

With reference to FIGS. 1-4, a fixing structure of a faucet according to the present invention comprises: a faucet 10 and a positioning device 100, wherein the positioning device 100 includes a base 20, two screw rods 30, and two clamping blocks 40.

The faucet 10 is a pull-out faucet or is not a pull-out faucet and is fixed on a sink countertop 2 with a hole 1, the sink countertop 2 is comprised of a top plate of a kitchen cabinet, and the kitchen cabinet has a water sink, wherein the faucet 10 is fixed on the sink countertop 2 around the water sink.

In this embodiment, the faucet 10 is a single handle pull-out faucet and includes a housing 11 and a pull-out spray head 12 for being pulled outward by a user, a mixing valve 13 mounted in the housing 11, and a water supply set 14. The water supply set 14 includes a cold-water inlet pipe 141 connected with the mixing valve 13, a hot-water inlet pipe 142, and a valve outlet pipe 143 coupled with the hot-water inlet pipe 142 and the mixing valve 13; a spray hose 144 connected between the pull-out spray head 12 and the valve outlet pipe 143; a water hammer 140 disposed on the spray hose 144; and a mixing outlet pipe 145 comprised of the valve outlet pipe 143 and the spray hose 144.

Figure 2:
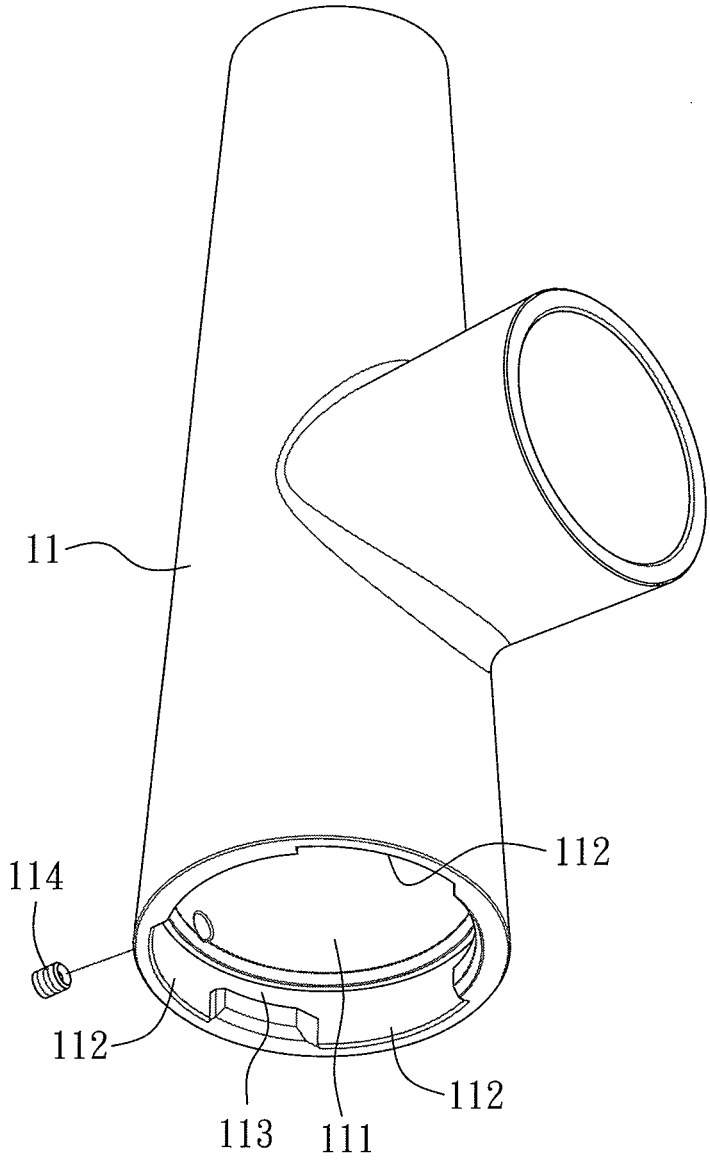
FIG. 2 is a perspective view showing the assembly of a housing of the fixing structure of the faucet according to the preferred embodiment of the present invention.
Figure 3:
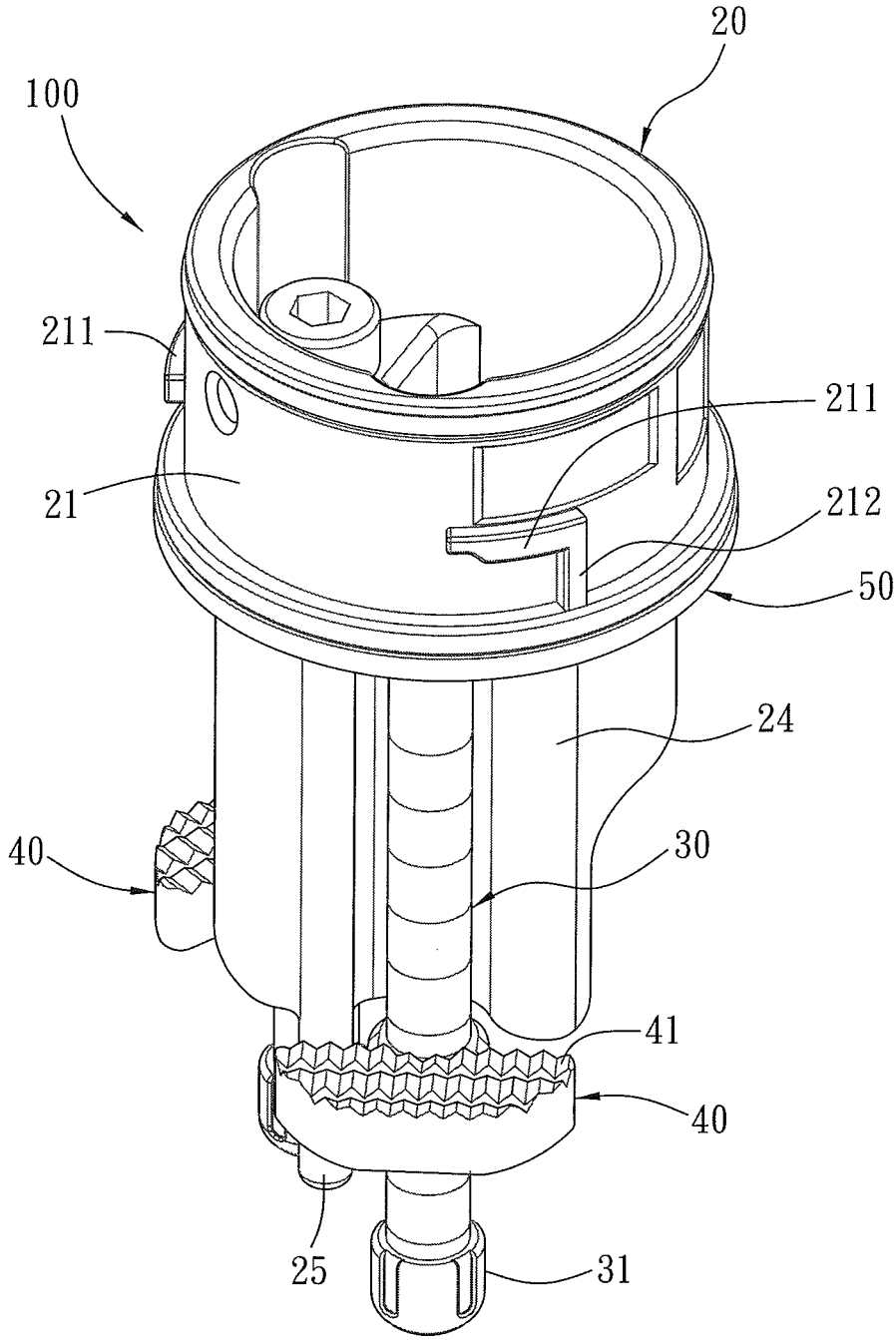
FIG. 3 is a perspective view showing the assembly components of a positioning device of the fixing structure of the faucet according to the preferred embodiment of the present invention.
Figure 4:
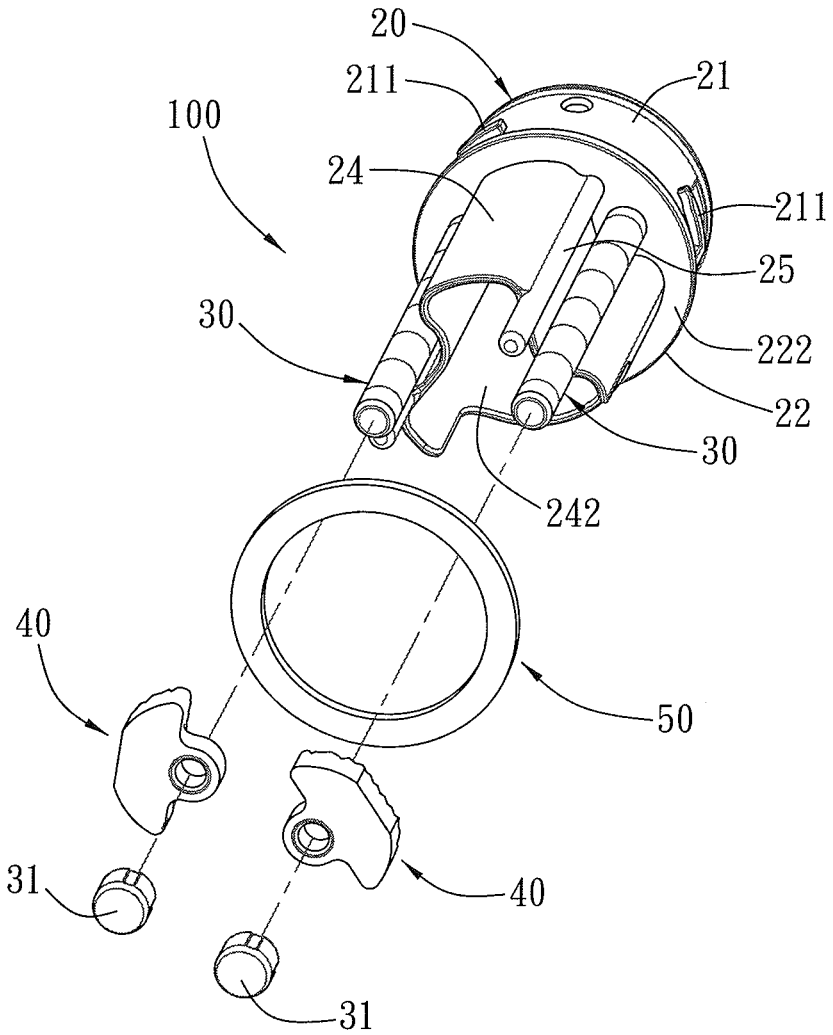
FIG. 4 is a perspective view showing the exploded components of the positioning device of the fixing structure of the faucet according to the preferred embodiment of the present invention.
Figure 5:
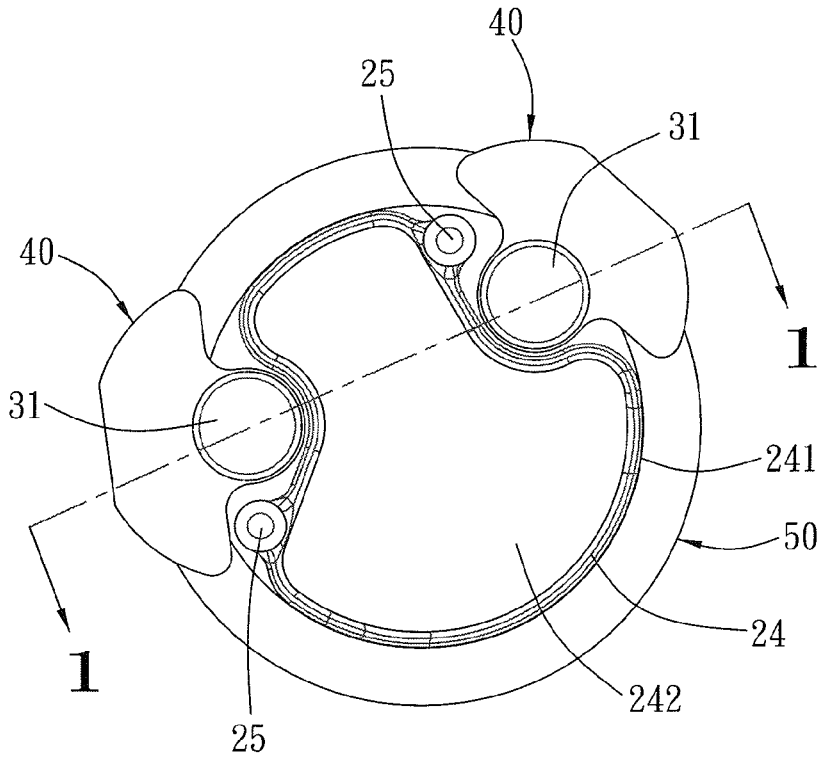
FIG. 5 is a plan view showing the assembly of a base of the fixing structure of the faucet according to the preferred embodiment of the present invention.

Referring further to FIG. 2, the housing 11 includes an opening 111 formed on a bottom end thereof, a plurality of longitudinal recesses 112 defined around an inner peripheral wall thereof and being adjacent to the opening 111, a groove 113 surrounding the inner peripheral wall thereof and communicating with the plurality of longitudinal recesses 112, and a locking element 114 secured in an outer peripheral wall thereof adjacent to the bottom end of the housing 11.

Figure 8:
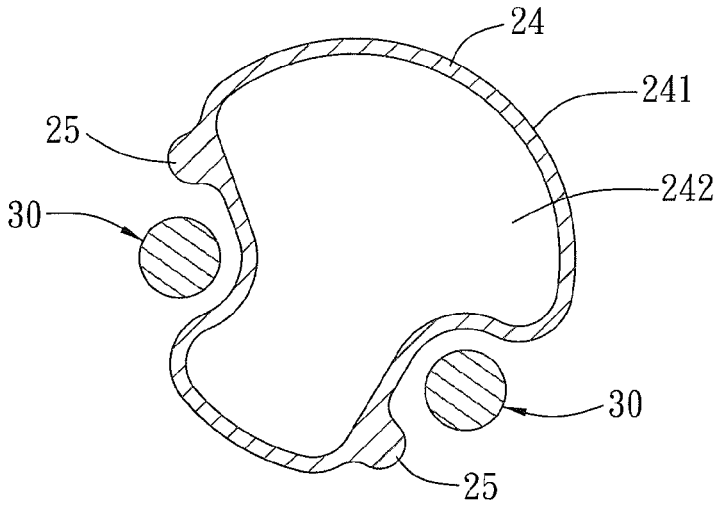
FIG. 8 is a cross sectional view taken along the line 2-2 of FIG. 7.
Figure 6:
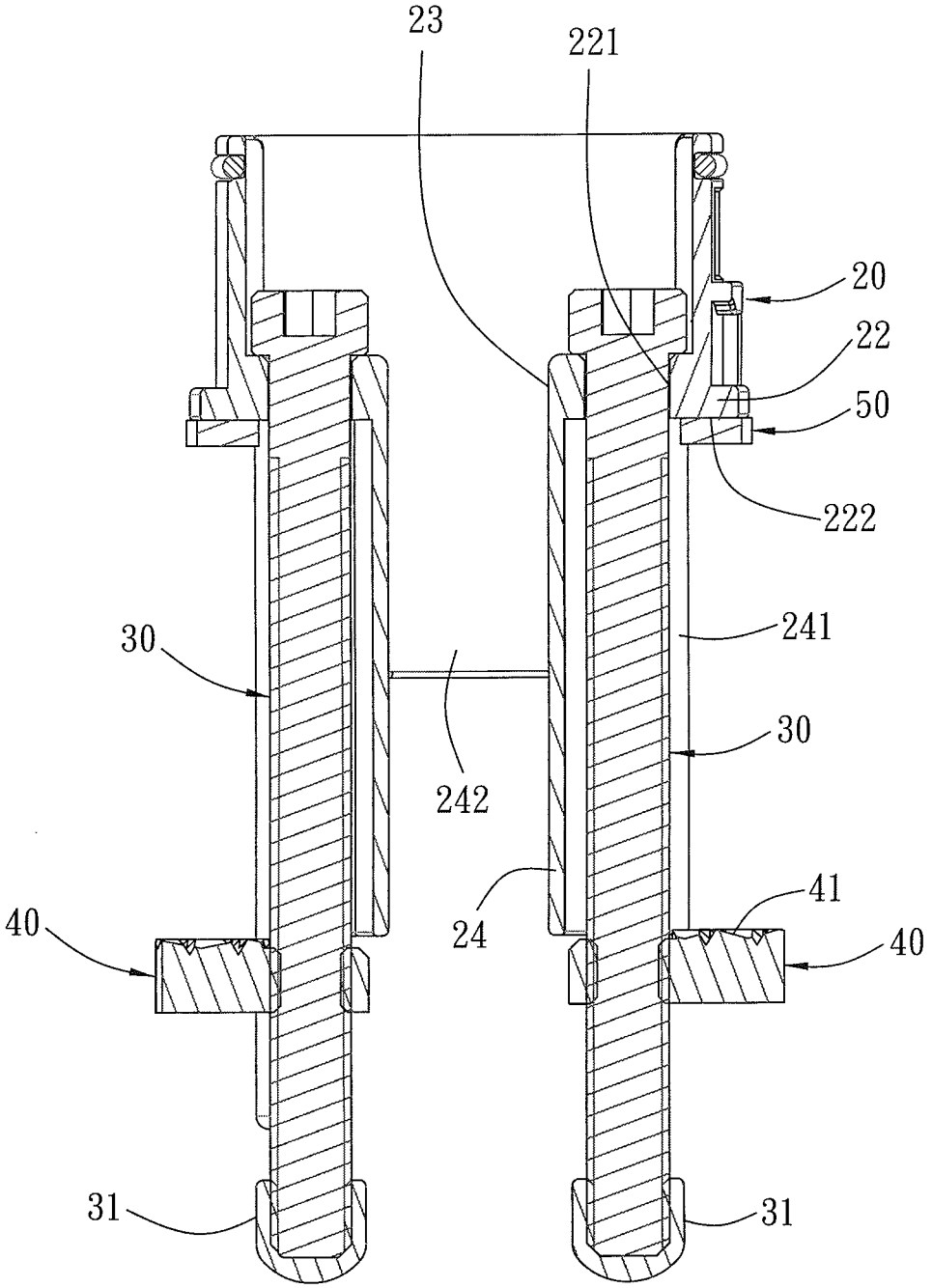
FIG. 6 is a cross sectional view taken along the line 1-1 of FIG. 5.
Figure 7:
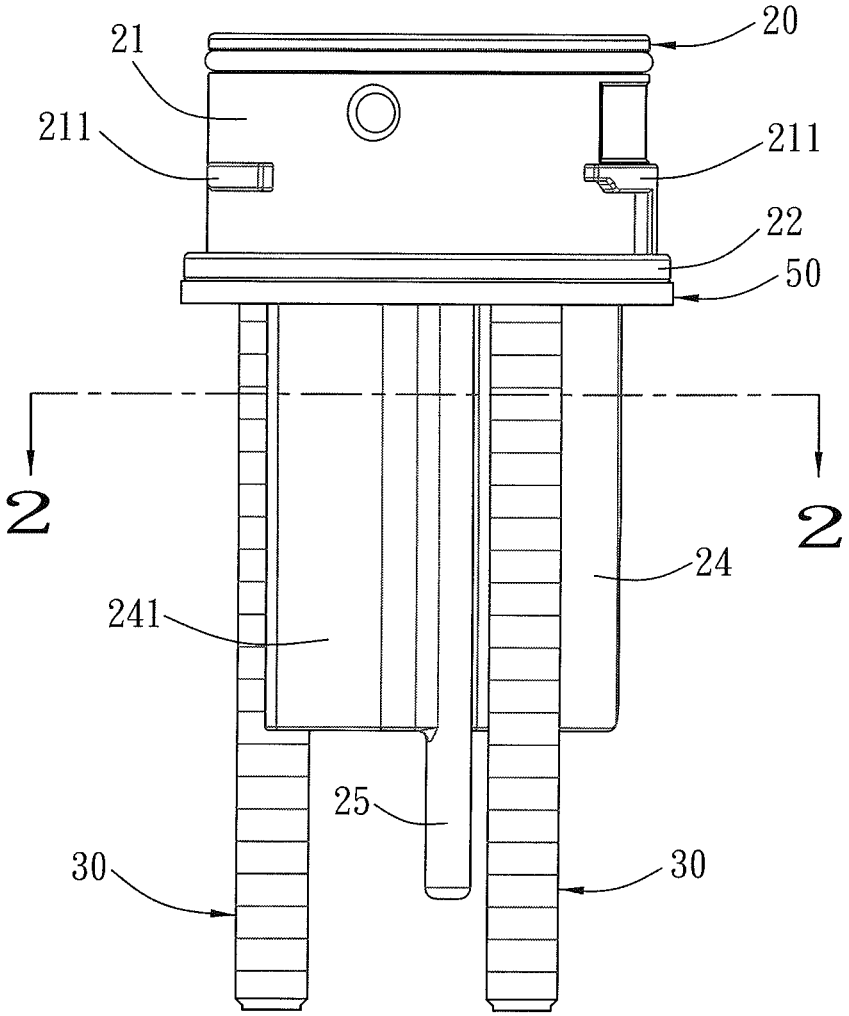
FIG. 7 is a cross sectional view showing the assembly of a part of the positioning device of the fixing structure according to the preferred embodiment of the present invention.

As shown in FIGS. 3-6, the base 20 includes a peripheral fence 21, a bottom fence 22 connected with the peripheral fence 21, a mouth 23 defined on the bottom fence 22. The bottom fence 22 has a limiting face 24 extending downwardly from the mouth 23, and the limiting face 24 forms a successive and closed wall in a circumferential direction, as illustrated in FIGS. 7 and 8, the limiting face 24 passes through the hole 1 of the sink countertop 2 and has an outer rim retained with the hole 1, such that the base 20 aligns with the hole 1. The limiting face 24 also has a channel 242 for communicating with the water supply set 14 and has two stop posts 25 coupled therewith and downwardly extending out of the hole 1, wherein a bottom end of each stop post 25 extends beyond a bottom end of the limiting face 24. The bottom fence 22 has at least one orifice 221 defined on an outer periphery of the limiting face 24 and being adjacent to the two stop posts 25; the bottom fence 22 also has an abutting face 222 formed on a bottom end thereof and around the limiting face 24 and the at least one orifice 221 so as to abut against a top wall of the hole 1 of the sink countertop 2.

The peripheral fence 21 of the base 20 has a plurality of sliding projections 211, such that when the opening 111 of the housing 11 is fitted with the base 20, the plurality of sliding projections 211 slide into the plurality of longitudinal recesses 112 and are rotated into the groove 113 so as to limit the housing 11 axially. Also, one of the plurality of sliding projections 211 has a stopping portion 212 for abutting against one of the plurality of longitudinal recesses 112 so as to further limit the housing 11 circumferentially.

It is to be noted that the locking element 114 is a screw bolt for locking the housing 11 on the base 20.

Each screw rod 30 extends out of the hole 1 of the sink countertop 2 from each of the at least one orifice 221 of the base 20 and is rotated above the base 20.

Each clamping block 40 is screwed with the each screw rod 30 and is limited by the each stop post 25 to rotate when the each screw rod 30 is rotated, and then the each clamping block 40 moves upwardly to retain a bottom end of the sink countertop 2 so as to further fix the base 20 in the hole 1 of the sink countertop 2 securely.

The each clamping block 40 has plural teeth 41 for meshing with the bottom end of the sink countertop 2, such that the each clamping block 40 retains with the bottom end of the sink countertop 2 tightly.

In addition, a bottom end of the each screw rod 30 is screwed with a defining sleeve 31 so as to limit the each clamping block 40 to move downwardly, thus preventing the each clamping block 40 from disengagement from the each screw rod 30. It is to be noted that before screwing the bottom end of the each screw rod 30 with the defining sleeve 31, an adhesive agent is applied onto the each screw rod 30 and the defining sleeve 31 so as to enhance a screwing tightness of the each screw rod 30 and the defining sleeve 31.

The fixing structure of the faucet of the present invention further comprises a washer 50 fixed between the abutting face 222 of the base 20 and the hole 1 of the sink countertop 2.

Thereby, the limiting face 24 of the base 22 forms a successive and closed wall in the circumferential direction so that after the base 20 is placed into the hole 1 of the sink countertop 1, the base 20 aligns with the hole 1 accurately, such that the base 20 is fixed on the sink countertop 2 easily and precisely.

The each stop post 25 of the base 20 facilitates rotating the each screw rod 30 above the base 20 directly so as to control a movement of the each clamping block 40, such that the clamping block 40 retains with the bottom end of the sink countertop 2 tightly, and the user does not have to operate the each clamping block 40 or to fix the base 20 below the sink countertop 2, thus fixing the base easily and quickly.

The each stop post 25 is coupled with the limiting face 24 so as to increase its structural reinforcement even though the each stop post 25 is made of plastic material. For example, the each clamping block 40 is limited by the each stop post 25 to rotate when the each screw rod 30 is rotated, and then the each clamping block 40 moves upwardly to retain the bottom end of the sink countertop 2 so as to further fix the base 20 in the hole 1 of the sink countertop 2 securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fixing structure of a faucet being fixed on a sink countertop with a hole and comprising:

a faucet including a housing, a pull-out spray head, a mixing valve mounted in the housing, and a water supply set; the water supply set including a cold-water inlet pipe connected with the mixing valve, a hot-water inlet pipe, and a mixing outlet pipe; one end of the mixing outlet pipe connecting with the pull-out spray head;

a positioning device including a base having a peripheral fence, a bottom fence connected with the peripheral fence, and a mouth defined on the bottom fence; the bottom fence having a limiting face extending downwardly from the mouth, and the limiting face being a successive and closed wall in a circumferential direction and passing through the hole of the sink countertop and having an outer rim retained with the hole, such that the base aligns with the hole; the limiting face also having a channel for communicating with the water supply set and having two stop posts coupled therewith and downwardly extending out of the hole, a bottom end of each stop post extending beyond a bottom end of the limiting face; the bottom fence having at least one orifice defined on an outer periphery of the limiting face and being adjacent to the two stop posts; the bottom fence also having an abutting face formed on a bottom end thereof and around the limiting face and the at least one orifice so as to abut against a top wall of the hole of the sink countertop;

two screw rods extending out of the hole of the sink countertop from the at least one orifice of the base and being rotated above the base;

two clamping blocks screwed with the two screw rods and limited by the two stop posts to rotate when the two screw rods are rotated, and then the two clamping blocks moving upwardly to retain a bottom end of the sink countertop so as to further fix the base in the hole of the sink countertop.

2. The fixing structure of the faucet as claimed in claim 1, wherein a bottom end of each screw rod is screwed with a defining sleeve so as to limit each clamping block to move downwardly, thus preventing the each clamping block from disengagement from the each screw rod.

3. The fixing structure of the faucet as claimed in claim 2, wherein an adhesive agent is applied onto the each screw rod and the defining sleeve so as to enhance a screwing tightness of the each screw rod and the defining sleeve.

4. The fixing structure of the faucet as claimed in claim 1, wherein the peripheral fence of the base has a plurality of sliding projections, the housing includes an opening formed on a bottom end thereof, a plurality of longitudinal recesses defined around an inner peripheral wall thereof and being adjacent to the opening, a groove surrounding the inner peripheral wall thereof and communicating with the plurality of longitudinal recesses, such that when the opening of the housing is fitted with the base, wherein the plurality of sliding projections slide into the plurality of longitudinal recesses and are rotated into the groove so as to limit the housing axially; one of the plurality of sliding projections has a stopping portion for abutting against one of the plurality of longitudinal recesses so as to further limit the housing circumferentially.

5. The fixing structure of the faucet as claimed in claim 1, wherein the housing also includes a locking element secured in an outer peripheral wall thereof adjacent to the bottom end of the housing so as to locking the housing on the base.

6. The fixing structure of the faucet as claimed in claim 1 further comprising a washer fixed between the abutting face of the base and the hole of the sink countertop.

7. The fixing structure of the faucet as claimed in claim 1, wherein the each clamping block has plural teeth for meshing with the bottom end of the sink countertop.

* * * * *